United States Patent [19]

Breckenridge et al.

[11] Patent Number: 4,906,353

[45] Date of Patent: Mar. 6, 1990

[54] DUAL MODE HYDROCARBON CONVERSION PROCESS

[75] Inventors: Lloyd L. Breckenridge, Philadelphia; Catherine L. Markham, Thornton, both of Pa.

[73] Assignee: Mobil Oil Corp., New York, N.Y.

[21] Appl. No.: 313,934

[22] Filed: Feb. 23, 1989

Related U.S. Application Data

[63] Continuation-in-part of Ser. No. 125,905, Nov. 27, 1987, abandoned.

[51] Int. Cl.[4] ..... C10G 35/09; C10G 47/18; C10G 63/04

[52] U.S. Cl. ..... 208/68; 208/46; 208/70; 208/111; 208/138

[58] Field of Search ..... 208/46, 67, 68, 70, 208/111, 135, 138

[56] References Cited

U.S. PATENT DOCUMENTS

| | | | |
|---|---|---|---|
| 3,663,425 | 5/1972 | Pollitzer et al. | 208/60 |
| 3,719,586 | 3/1973 | Benner | 208/60 |
| 3,806,443 | 4/1974 | Mazuik | 208/60 |
| 3,867,276 | 2/1975 | Berger | 208/60 |
| 3,899,411 | 8/1975 | Bonacci et al. | 208/66 |
| 3,928,174 | 12/1975 | Bonnacci et al. | 208/80 |
| 4,036,735 | 7/1977 | Roselius et al. | 208/66 |
| 4,054,539 | 10/1977 | Hensley, Jr. | 208/111 |
| 4,127,471 | 11/1978 | Suggit et al. | 208/58 |
| 4,137,146 | 1/1979 | Meyer | 208/60 |
| 4,178,230 | 12/1979 | Johnson et al. | 208/66 |
| 4,212,727 | 7/1980 | Antos | 208/111 |
| 4,647,368 | 3/1987 | McGuiness et al. | 208/60 |
| 4,665,272 | 5/1987 | Bakas et al. | 208/138 |
| 4,676,887 | 6/1987 | Fischer et al. | 208/68 |
| 4,752,595 | 6/1988 | McCullen | 502/53 |
| 4,827,076 | 5/1989 | Kokayeff et al. | 208/212 |

*Primary Examiner*—Anthony McFarlane
*Attorney, Agent, or Firm*—Alexander J. McKillop; Charles J. Speciale; Dennis P. Santini

[57] ABSTRACT

A dual-mode hydrocarbon conversion process is provided which comprises reforming a sulfur-, nitrogen- and/or olefin-containing hydrocarbon feedstock, e.g. an FCC gasoline, in a conversion unit operated under reforming conditions employing as catalyst a noble metal-containing crystalline silicate having a Constraint Index of not greater than about 2 and a framework $SiO_2/Al_2O_3$ ratio of at least about 50 to provide a relatively high yield of high octane reformate and a relatively low yield of $C_{3-4}$ hydrocarbons prior to or following hydrocracking the feedstock in the unit operated under hydrocracking conditions in the presence of the aforesaid catalyst to provide a relatively low yield of high octane hydrocrackate and a relatively high yield of $C_{3-4}$ hydrocarbons. The latter can be separated from the liquid product and processed in a gas plant to provide LPG products. The dual-mode process of this invention offers the refiner increased flexibility in meeting rapidly fluctuating changes in demand for high octaine gasoline and LPG products.

14 Claims, No Drawings

DUAL MODE HYDROCARBON CONVERSION PROCESS

CROSS-REFERENCE TO RELATED APPLICATIONS

This is a continuation-in-part of application Ser. No. 125,905, filed Nov. 27, 1987, now abandoned.

BACKGROUND OF THE INVENTION

The present invention relates to a process for upgrading a sulfur-, nitrogen- and/or olefin-containing feedstock, e.g. a thermally or catalytically cracked gasoline, in a dual mode operation in which the feedstock is alternately and selectively subjected to catalytic reforming under conditions conducive to the production of high octane reformate preceding or following the hydrocracking of the feedstock under conditions conducive to the production of $C_{3-4}$ hydrocarbons, both modes employing as catalyst the identical Group VIII noble metal-containing large pore zeolite catalyst, e.g. platinum-containing ultrastable zeolite Y (PtUSY).

Reforming is widely used in petroleum refining to convert naphtha of unacceptable octane number into components of relatively higher octane number. Several reactions contribute to this increase in octane number. The reactions of greater significance are the formation of aromatics by dehydrogenation of naphthenes and paraffins, the dehydrocycylization of aliphatics and the hydrocracking of high molecular weight paraffins. Isomerization is another potential octane-increasing reaction of the lower molecular weight paraffins, especially $C_5$ and $C_6$, but for this purpose specific isomerization processes have also been developed. However, at the usual aromatizing conditions isomerization of high molecular weight paraffins is of secondary importance because the octane number of the thermodynamic equilibrium product decreases as the molecular weight increases.

In the reforming process the initial low octane naphtha feed is heated to a suitable reforming temperature, typically about 450°–500° C., and passed over a reforming catalyst in the presence of hydrogen in a series of reactors. Because the reforming reactions are cumulatively endothermic, interstage heating between the reactors is generally necessary to maintain the desired rate of reaction. As the naphtha progresses from one reactor to the next, the aromatics content increases and with it, the octane number of the product.

The catalysts used in known and conventional reforming operations generally comprise a hydrogenation-dehydrogenation component and an acidic component as both types of functionality are required for the foregoing reforming reactions. The metal component can be either a noble metal of Group VIII of the Periodic Table, e.g. platinum, or a base metal or combination of base metals, usually from Groups VIB, e.g. tungsten, and VIII of the Periodic Table. Commercial processes such as platforming which use noble metals such as platinum or platinum-iridium result in the most efficient conversion of naphthenes and paraffins to aromatics; but processes using base metal catalysts such as nickel, cobalt, tungsten, molybdenum and vanadium and especially combinations thereof such as cobalt-molybdenum and nickel-tungsten have, in certain circumstances, been preferred because of their ability to handle chargestocks which are high in contaminants. The acidic component of the reforming catalyst has conventionally been an amorphous material such as alumina or silica-alumina. Proposals have been made for using zeolitic reforming catalyst, for example, as described in U.S. Pat. Nos. 4,010,093; 4,191,638; 4,276,151; and 4,141,859; but in these proposals the zeolite has always been used in combination with a conventional amorphous catalyst rather than on its own. Proposals have also been put forward suggesting that reforming processes should be combined with reformate upgrading processes using zeolite catalysts, for example, as described in U.S. Pat. Nos. 3,729,409 and 4,292,167; but zeolites have not achieved acceptance as the reforming catalysts. Thus, the acidic component has generally been a porous adsorptive material having a surface area exceeding 20 square meters per gram and, preferably, greater than about 100 square meters per gram. Refractory inorganic oxides are preferred supports, particularly alumina or mixtures of alumina with silica. Alumina is particularly preferred and may be used in a large variety of forms including alumina precipitate or gel, alumina monohydrate, sintered alumina and the like. Various forms of alumina either singly or in combination, such as eta, chi, gamma, theta, delta or alpha alumina, can be suitably employed as the alumina support. Preferably, the alumina is gamma alumina and/or eta alumina.

Hydrocracking is a versatile petroleum refining process which enjoys widespread use in the refining industry to convert higher boiling hydrocarbons into lighter products. Hydrocracking has the ability to process a wide range of difficult feedstocks into a variety of desirable products. Feedstocks which can be treated by this process include heavy naphthas, kerosenes, refractory catalytically cracked cycle stocks and high boiling virgin and coker gas oils. At high severities, hydrocracking can convert these materials to gasoline and lower boiling paraffins. Lesser severities permit the higher boiling feedstocks to be converted into lighter distillates such as diesel fuels and aviation kerosenes.

Hydrocracking is conventionally carried out at moderate temperaures, e.g. of 500° F. to 850° F., and at high total pressures, e.g. over 100 psig, because the thermodynamics of the hydrocracking process become unfavorable at higher temperatures. In addition, high hydrogen partial pressures, e.g. on the order of from about 25 to 60% of total pressure, are generally required to prevent catalyst aging and thus maintain sufficient activity to enable the process to be operated with a fixed bed of catalyst for periods of one to two years without the need for regeneration. The catalysts used for hydrocracking usually comprise a transition metal such as nickel, cobalt, tungsten or molybdenum on an acidic support such as alumina or silica-alumina, although noble metals such as platinum can also be used. Combinations of metals such as cobalt with molybdenum have been found to be extremely effective with a wide variety of feedstocks as has the presulfiding technique which is now widely employed.

During the hydrocracking reaction the bulky polycyclic compounds in the feedstock enter the pore structure of the catalyst where they are cracked and hydrogenated to form lower molecular weight monocyclic aromatics with saturated side chains. Because these reactions generally predominate in the hydrocracking proces as a whole, it has generally been considered necessary that the acidic component should permit ready access to the bulky polycyclic aromatics. For this reason porous supports of large pore size have usually been selected. Amorphous silica-alumina supports have frequently been used in commercial processes because they have a suitably large pore size, as have large pore crystalline aluminosilicate zeolites of the faujasite family, e.g. faujasite, zeolite X and zeolite Y. In some processes which have been proposed, the amorphous material is used together with a crystalline zeolite, e.g. as described in U.S. Pat. No. 3,523,887.

Hydrocracking processes using hydrogen form zeolite Y as the acidic component are described, for example, in U.S. Pat. Nos. 3,269,934 and 3,524,809. Zeolite ZSM-20 which resembles faujasite in certain aspects of structure, but which has a higher silica:alumina ratio, usually with the range from 7:1 to 10:1, has also been proposed for use as the acidic component of a hydrocracking catalyst in U.S. Pat. No. 4,021,331 and European Patent 14,291. The silica:alumina ratios of these catalysts have remained, however, at a relatively low value, not higher than about 7:1 to 8:1.

Serial hydrocarbon conversion processes are known in which reforming is followed by hydrocracking, or vice versea, in separate reactors employing different catalyst compositions for each conversion operation.

U.S. Pat. No. 3,663,425 describes a combination process involving the hydrocracking of an aromatics-containing heavier-than-gasoline charge stock in admixture with hydrogen to saturate the aromatics and thereafter subjecting at least a portion of the hydrocracking product to dehydrogenation below 100 psig to convert naphthenes to aromatics. A Group VIII metal component on an acid carrier, e.g., a zeolite such as mordenite or faujasite, is used in the hydrocracking operation and a Group VIII metal component on a non-acidic carrier, e.g. alumina, is used in the dehydrogenation operation. U.S. Pat. No. 3,806,443 describes the processing of naphtha to produce significant yields of LPG and an aromatic-rich concentrate by the selective hydrocracking of normal paraffins to LPG material with a small pore zeolite hydrocracking catalyst, e.g. erionite, before and after platinum reforming. U.S. Pat. No. 3,928,174 describes a combination process wherein the product of a reforming operation is subsequently subjected to a selective zeolite hydrocracking operation designed to convert low boiling normal paraffins to LPG product. U.S. Pat. No. 4,054,539 describes a combination process in which a hydrocarbon feedstock having an initial boiling point of at least 350° F. is subjected to hydrocracking employing as catalyst cobalt and molybdenum on an ultrastable large pore zeolite, e.g. ultrastable Y zeolite (USY), separating the hydrocracked product by selective solvent extraction into an aromatic extract and a non-aromatic raffinate, reforming the non-aromatic raffinate employing a platinum-containing catalyst and blending the resulting reformate with the aromatic extract. According to U.S. Pat. No. 4,178,230, a hydrocrabon charge stock boiling below 500° F. is converted into aromatic hydrocarbons and isobutane via a combination process involving reforming, hydrocracking and subsequent reforming using a variety of catalysts. U.S. Pat. No. 4,647,368 subjects a full range naphtha to hydrocracking over zeolite Beta to provide a hydrocracked product comprising isobutane, $C_{5-7}$ paraffins and higher boiling naphthenes and paraffins. Following the removal of the isobutane and $C_{5-7}$ paraffins, the product which remains is subjected to reformaing utilizing a conventional noble metal reforming catalyst such as platinum-rhenium on alumina.

Processes effecting the simultaneous reforming and hydrocracking of a hydrocarbon charge stock are also known.

U.S. Pat. No. 3,365,392 describes a process for the simultaneous conversion of a hydrocarbon charge stock such as naphtha or an FCC gasoline in admixture with hydrogen to $C_{3-4}$ hydrocarbons and a high octane reformate employing as catalyst a mordenite-type zeolite in association with a platinum group metal. U.S. Pat. No. 3,899,411 describes a combination of a reforming catalyst based on platinum-alumina and a hydrocracking catalyst based on zeolite such as erionite for use in the simultaneous reforming and hydrocracking of a naphtha or reformate feed. Another combination reforming and hydrocracking catalyst composition, i.e. a physical mixture of platinum and a platinum promoter on alumina or other porous carrier such as a zeolite as the hydrocracking components and a Group VIII metal component on a zeolite such as mordenite as the hydrocracking component, is described in U.S. Pat. No. 4,212,727.

Today wide fluctuations are common in refinery product price structure. For example, the value of incremental octane or the value of LPG relative to gasoline changes almost daily depending on refinery inventories and consumer demands. Therefore, a hydrocarbon conversion unit with the ability to shift from a reforming mode where high yields of gasoline and excess hydrogen are produced to a hydrocracking mode where lower yields of high octane gasoline and higher yields of $C_{3-4}$ hydrocarbons are produced would be highly advantageous for the product slate flexibility it would offer to the refiner. Heretofore it is believed not to have been known to provide a hydrocarbon conversion process in which the same hydrocarbon feed is alternately and selectively converted in a common conversion unit operated under either predominantly reforming conditions to favor the production of high octane reformate or predominately under hydrocracking conditions to favor the production of $C_{3-4}$ hydrocarbons while utilizing the same large pore zeolite catalyst in both conversion operations.

It is an object of the present invention to provide a dual-mode hydrocarbon conversion process selectively operated in a reforming mode preceding and/or following a hydrocracking mode and carried out in the same conversion unit employing the same noble metal-containing large pore zeolite catalyst in both modes of operation.

It is a particular object of the present invention to subject a sulfur-, nitrogen- and/or olefin-containing hydrocarbon feedstock, e.g. an FCC gasoline, to reforming employing a noble metal-containing ultrastable zeolite Y as catalyst to provide a high yield of high octane gasoline and relatively little gasiform product and, as desired, to shift the operation of the conversion unit to a hydrocracking mode employing the same catalyst to provide a relatively high yield of saturated gasiform product, principally $C_{3-4}$ hydrocarbons.

SUMMARY OF THE INVENTION

In accordance with the present invention, and by way of realizing the foregoing and other objects of the invention, there is provided a dual-mode hydrocarbon conversion process which comprises reforming a sulfur-, nitrogen- and/or olefin-containing hydrocarbon feedstock in a conversion unit operated under reforming conditions employing as catalyst a noble metal-containing crystalline silicate having a Constraint Index of not greater than about 2 and a framework $SiO_2/Al_2O_3$ ratio of at least about 50 to provide a relatively high yield of high octane reformate and a relatively low yield of $C_{3-4}$ hydrocarbons prior to or following hydrocracking the feedstock in the unit operated under hydrocracking conditions and employing the aforesaid catalyst to provide a relatively low yield of high octane hydrocrackate and a relatively high yield of $C_{3-4}$ hydrocarbons.

It has been discovered that when the hydrocarbon conversion unit is operated in the hydrocracking mode, although the yield of high octane gasoline is reduced compared to that obtained when operated in the reforming mode, since a good deal more $C_{3-4}$ hydrocarbons are produced, the hydrocracked product is of comparable value to the reformate product when demand for the gaseous hydrocarbons is high.

DESCRIPTION OF THE PREFERRED EMBODIMENTS

The hydrocarbon feedstock of the present invention is one containing sulfur- and/or nitrogen-bearing components and/or olefinic components. The presence of such components in significant amounts normally requires that the feedstock be subjected to hydrotreatment in order to be passed over a conventional reforming catalyst. A gasoline derived from catalytic cracking or thermocracking is one type of feedstock which is well suited for use in the dual-mode conversion process of this invention. The catalytic cracking process can be either a fluid catalytic cracking (FCC) process or a thermoform catalytic cracking (TCC) process. Feedstocks of the present invention can possess a boiling range, e.g. above about 350° F., which exceeds the boiling range of feestocks which are commonly processed over conventional reforming catalysts. Feedstocks of relatively high boiling range are not normally processed in a conventional reformer. Such feedstocks are generally blended into a gasoline pool which is then hydrotreated for further processing.

The catalyst employed in the dual-mode hydrocarbon conversion process of this invention is a large pore zeolite having a Contraint Index of not greater than about 2 as described hereinafter. For purposes of this invention, the term "zeolite" is meant to represent the class of porotectosilicates, i.e. porous crystalline silicates, which contain silicon and oxygen atoms as the major components. Other components can be present in minor amounts, usually less than 14 mole %, and preferably less than 4 mole %. These components include aluminum, gallium, iron, boron and the like, with aluminum being preferred, and used herein for illustration purposes. The minor components can be present separately or in mixtures in the catalyst. They can also be present intrinsically in the structure of the catalyst.

The framework silica-to-alumina mole ratio referred to can be determined by conventional analysis. This ratio is meant to represent, as closely as possible, the ratio in the rigid anionic framework of the zeolite crystal and to exclude aluminum in the binder or in cationic or other forms within the channels. Although zeolites with a silica-to-alumina mole ratio of at least 10 are useful, it is preferred to use zeolites having much higher silica-to-alumina mole ratios, i.e. ratios of at least 50:1 and preferably greater than about 500:1. In addition, zeolites, as otherwise characterized herein but which are substantially free of aluminum, i.e. having silica-to-alumina mole ratios approaching infinity, are found to be useful and even preferable in some instances. The novel class of zeolites, after activation, acquire an intracrystalline sorption affinity for normal hexane which is greater than that for water, i.e. they exhibit "hydrophobic" properties.

A convenient measure of the extent to which a zeolite provides control to molecules of varying sizes to its internal structure is the Constraint Index of the zeolite. A zeolite which provides a highly restricted access to and egress from its internal structure has a high value for the Constraint Index and usually possesses pores of small size, e.g. less than 5 Angstroms. On the other hand, a zeolite which provides relatively free access to the internal zeolite structure has a low value for the Constraint Index and usually pores of large size, i.e. greater than 8 Angstroms. The method by which Constraint Index is determined is described fully in U.S. Pat. No. 4,016,218, to which reference is made for the details thereof.

Constraint Index (CI) values for some typical materials are:

| | CI (at test temperature) |
|---|---|
| ZSM-4 | 0.5 (316° C.) |
| ZSM-20 | 0.5 (371° C.) |
| TEA Mordenite | 0.4 (316° C.) |
| Mordenite | 0.5 (316° C.) |
| REY | 0.4 (316° C.) |
| Amorphous Silica-alumina | 0.6 (538° C.) |
| Dealuminized Y (Deal Y) | 0.5 (510° C.) |
| Zeolite Beta | 0.6–2.0 (316° C.–399° C.) |

The above-described Constraint Index is an important and even critical definition of those zeolites which are useful in the dual-mode hydrocarbon conversion process of the present invention. The very nature of this parameter and the recited technique by which it is determined, however, admit of the possibility that a given zeolite can be tested under somewhat different conditions and thereby exhibit different Constraint Indices. Constraint Index seems to vary somewhat with severity of operation (conversion) and the presence or absence of binders. Likewise, other variables, such as crystal size of the zeolite, the presence of occluded contaminants, etc., can affect the Constraint Index. Therefore, it will be appreciated that it may be possible to so select test conditions, e.g. temperatures, as to establish more than one value for the Constraint Index of a particular zeolite. This explains the range of Constraint Indices for Zeolite Beta.

Zeolite ZSM-4 is described in U.S. Pat. No. 3,923,639, to which reference is made for details of this catalyst.

Zeolite ZSM-20 is described in U.S. Pat. No. 3,972,983, to which reference is made for details of this catalyst.

Zeolite Beta is described in U.S. Pat. No. 3,308,069 and RE. No. 28,341, to which reference is made for details of this catalyst.

Zeolite Y is described in U.S. Pat. No. 3,130,007, to which reference is made for details of this catalyst.

Low sodium Ultrastable Y molecular sieve (USY) is described in U.S. Pat. Nos. 3,293,192; 3,354,077, 3,375,065; 3,402,996; and 3,595,611, to which reference is made for details of this catalyst.

Dealuminized Y zeolite (Deal Y) may be prepared by the method found in U.S. Pat. No. 3,442,795, to which reference is made for details of this catalyst.

Zeolite UHP-Y is described in U.S. Pat. No. 4,401,556, to which reference is made for details of this catalyst.

The large pore zeolites, i.e. those zeolites having a Constraint Index of not greater than about 2, are well known to the art and have a pore size sufficiently large to admit the vast majority of components normally found in the useful feedstock herein. Such zeolites are generally considered to have a pore size in excess of about 7 Angstroms and are respresented by zeolites having the structures of, for example, zeolite Beta, zeolite L, zeolite Y, ultrastable zeolite Y (USY), dealuminized Y (Deal Y), mordenite, ZSM-3, ZSM-4, ZSM-18 and ZSM-20. A crystalline silicate zeolite well known in the art and useful in the present invention is faujasite. ZSM-20 resembles faujasite in certain aspects of structure but has a notably higher silica/alumina ratio than faujasite, as does Deal Y.

Although zeolite Beta has a Constraint Index equal to or less than 2, it is to be noted that it does not have the same structure as the other large pore zeolites and does not behave exactly as a large pore zeolite. However, zeolite Beta does satisfy the requirements for a catalyst of the present invention.

The catalyst should be comprised of a source of acidity, i.e. an Alpha Value of greater than about 0.1. Alpha Value, a measure of zeolite acidic funtionality, is described together with details of its measurement in U.S. Pat. No. 4,016,218 and in *J. Catalysis,* Vol. 4, p. 527 (1965); Vol. 6, p. 278 (1966); and Vol. 61, p. 395 (1980), each incorporated herein by reference as to the description. The experimental conditions of the Alpha test used herein include a constant temperature of 538° C. and a variable flow rate as described in detail in *J. Catalysis,* Vol. 61, p. 395. A preferred source of zeolitic activity is a faujasite or other large pore zeolite which has a low acidity (Alpha between 1 and 200) due to (a) being synthesized with a high silica/alumina ratio; (b) steaming; (c) steaming followed by dealuminization; or (d) substitution of framework aluminum by one or more other non-acidic trivalent species. Also of interest are large pore zeolites whose surface acidity has been reduced or eliminated by treatment with bulky reagents or by surface poisoning.

It may be useful to incorporate the above-described zeolites with a matrix comprising another material which is resistant to the temperature and other conditions employed in the dual-mode hydrocarbon conversion process herein. Such matrix material is useful as a binder.

Useful matrix materials include both synthetic and naturally-occurring substances, as well as inorganic materials such as clay, silica and/or metal oxides. The latter may be either naturally-occurring or in the form of gelatinous precipitates or gels including mixtures of silica and metal oxides. Naturally occurring clays which can be composited with the zeolite include the montmorillonite and kaolin family, which families include the subbentonites, and the kaolins commonly known as Dixie, McNamee, Georgia and Florida clays or others in which the main mineral constituent is halloysite, kaolinite, dickite, nacrite, or anauxite. Such clays can be used in the raw state as originally mined or initially subjected to calcination, acid treatment or chemical modification.

In addition to the foregoing materials, the zeolites employed herein can be composited with a porous matrix material such as alumina, silica, silica-alumina, silica-magnesia, silica-zirconia, silica-thoria, silica-beryllia, and silica-titania, as well as ternary compositions such as silica-alumina-thoria, silica-alumina-zirconia silica-alumina-magnesia and silica-magnesia-zirconia. The matrix can be in the form of a cogel. The relative proportions of zeolite components and inorganic oxide matrix, on an anhydrous basis, can vary widely, with the zeolite content ranging from between 1 to about 99 wt.%, and more usually in the range of about 5 to about 80 wt.% of the dry composite.

The original cations associated with the useful crystalline silicate zeolites herein can be replaced by a wide variety of other cations employing techniques well known in the art. Typical replacing cations include hydrogen, ammonium, alkyl ammonium and metal cations and their mixtures. Of the replacing metallic cations which are discussed more fully hereinafter, particular reference is given to noble metals, such as metals of Group VIII of the Periodic Table, e.g. platinum and palladium.

Typical ion-exchanging techniques involve contacting the particular zeolite with a salt of the desired replacing cation. Although a wide variety of salts can be employed, particular preference is given to chlorides, nitrates and sulfates. Representative ion-exchange techniques are disclosed in a number of patents, including U.S. Pat. Nos. 3,140,249; 3,140,251; and 3,140,253.

Following contact with a solution of the desired replacing cation, the zeolite is then preferably washed with water and dried at a temperature ranging from 150° to about 600° F., and thereafter calcined in air, or other inert gas, at temperatures ranging from about 500° to 1500° F. for periods of time ranging from 1 to 48 hours or more. Catalysts of improved selectivity and other beneficial properties can often be obtained by subjecting the zeolite to treatment with steam at elevated temperatures ranging from 500° to 1200° F., and preferably 750° to 1000° F. The treatment can be accomplished in an atmosphere of 100% steam or an atmosphere consisting of steam and a gas which is substantially inert to the selected zeolite. A similar treatment can be accomplished at lower temperatures and elevated pressure, e.g. 350° to 700° F. (177° to 371° C.) at 10 to about 200 atmospheres.

The crystalline silicate utilized in the process of this invention is desirably employed in intimate combination with a noble metal such as platinum or platinum in combination with the Group VIII metals, e.g. platinum-rhenium or platinum-iridium, in an amount between 0.1 and 25 wt.%, normally 0.1 to 5 wt.%, and preferably 0.3 to 3 wt.%. Such component can be exchanged into the composition, impregnated thereon, or physically admixed therewith. Such component can be impregnated into or onto the crystalline silicate, such as, for example, in the case of platinum, by treating the silicate with a platinum metal-containing ion. Thus, suitable platinum compounds include chloroplatinic acid, platinous chloride and various compounds containing the platinum amine complex.

The compounds of the useful platinum or other metals can be divided into compounds in which the metal is present in the cation of the compound and compounds in which it is present in the anion of the compound. Both types of compounds which contain the metal in the ionic state can be used. A solution in which platinum metals are in the form of a cation or cationic complex, e.g. $Pt(NH_3)Cl_2$, is particularly useful.

The present invention when operated in the reforming mode can, in a qualified sense, be regarded as a reforming process, since the reactions which take place are reforming reactions. However, the reforming mode of the process herein is not equivalent to a conventional reforming process per se in that it passes a sulfur-, nitrogen- and/or olefin-containing hydrocarbon feed at a high temperature over the catalyst directly cyclizing any olefins to aromatics and, in addition, increasing the octane value and reducing the sulfur/nitrogen content of the feedstock. Thus, unlike conventional reforming processes, the reforming mode of the process of the present invention (1) accepts sulfur- and/or nitrogen-containing feedstocks; (2) accepts olefin-containing feedstocks; and (3) accepts feedstocks with a high boiling point, i.e. in excess of 350° F.

The feedstock is contacted with the catalyst in the presence of hydrogen under reforming conditions of elevated temperature and pressure. Conditions of temperature, pressure, space velocity and hydrogen ratio are similar to those used in conventional reforming processes. Temperatures of from about 600° to about 1200° F., and, more commonly, from about 750° to about 1000° F., will be typical, as will be pressures from mildly superatmospheric up to about 350 psig, more commonly from about 100 to about 300 psig; space velocities from about 0.1 to about 20 LHSV, more commonly from about 0.5 to about 5 LHSV; and hydrogen circulation rates of from about 1000 to about 10,000 SCF/B and, more commonly, from about 1500 to about 3500 SCF/B.

The operating conditions selected for the hydrocracking mode include an operating pressure within the range of from above about 350 to about 1000 psig, preferably from about 400 to about 650 psig; a temperature within the range of about 500° F. to about 1000° F., e.g. from about 500° to about 800° F.; a volume hourly space velocity in the range of from about 1 to about 10, e.g. from 1 to about 4; and a hydrogen to hydrocarbon ratio within the range of from about 1 to about 10 to 1. Hydrogen consumption is about 100 or more SCF/B depending on the charge composition and operating conditions selected.

The invention is illustrated by the following examples in which all parts, proportions and percentages are by weight unless stated to the contrary.

EXAMPLE 1

This example illustrates the preparation of the catalyst composition employed in both modes, i.e. reforming and hydrocracking, of the dual-mode hydrocarbon conversion process of Example 2.

On a dry basis, 65 wt.% of USY (Z-14US, W. R. Grace) of 5.3:1 $SiO_2$:$Al_2O_3$ mole ratio was mixed with 35 wt.% of silica consisting of a mixture of 26.2 wt.% precipitated amorphous silica (PPG Industries HiSil 233 EP) abd 8.8 wt.% colloidal silica (Ludox, HS-30). The moisture content of the mix was adjusted to 43–45 wt.% with deionized water and the resulting paste was extruded to yield a 1/16" diameter extrudate. The resulting catalyst was dried at 250° F. overnight (approximately 18 hours) and calcined at 1000° F. for 3 hours in flowing air at a heating rate of 5° F./min. To effect sodium removal, the extrudate was exchanged three times with circulating 5 ml/g 1N $NH_4NO_3$ for 1 hour at ambient temperature. After drying at 250° F. and calcining at 1000° F. for 3 hours in flowing air, the catalyst was steamed at 1200° F. for 10 hours in 1 atm steam resulting in dealumination of the zeolite framework. To remove residual sodium and non-framework alumina generating during steaming, the extrudate was treated twice for 1 hour at ambient temperature with circulating 5 ml/g N $HNO_3$. After drying at 250° F. and calcining at 1000° F. for 3 hours in flowing air, the catalyst was again steamed and treated with 1N $HNO_3$ using substantially the same procedures as described. The Alpha of the extrudate was 3. Platinum was incorporated via excess solution column ion exchange with addition of $Pt(NH_3)_4Cl_2$ over a 4 hour period followed by an additional 8 hours of circulation. After washing the catalyst chlorine-free and drying at 250° F., the catalyst was calcined at 660° F. for 3 hours in flowing air at a heating rate of 2° F./min. The physical properties of the Pt catalyst are detailed in Table 1 as follows:

TABLE 1

| Physical Properties of Pt USY/$SiO_2$ | |
|---|---|
| Alpha (prior to Pt add'n) | 3 |
| Pt, Wt. % | 0.38 |
| Na, Wt. % | 0.1 |
| Density, g/cc | |
| Particle | 0.85 |
| Real | 2.35 |
| Surface Area, $m^2/g$ | 385 |
| Pore Volume, cc/g | 0.76 |

EXAMPLE 2

The Pt USY/$SiO_2$ catalyst composition of Example 1 was used in the process of the present invention employing as feed an FCC gasoline of the properties set forth in Table 2 below:

TABLE 2

| Properties of FCC Gasoline Feedstock | |
|---|---|
| Property | Value |
| RON + O | 93.4 |
| MON + O | 82.0 |
| Sulfur, ppmw | 3000 |
| Nitrogen, ppmw | 300 |
| Hydrogen, wt. % | 11.99 |
| Gravity, °API | 40.4 |
| Paraffins, wt. % | 13 |
| Naphthenes, wt. % | 20 |
| Olefins, wt. % | 16 |
| Aromatics, wt. % | 51 |

The operating conditions of the dual-mode process were as follows:

| | |
|---|---|
| Reforming Mode: | |
| LHSV, $hr^{-1}$ | 4 |
| Temperature, °F. | 900 |
| Pressure, psig | 250 |
| Hydrogen, SCF/B | 9000 |
| Hydrocracking Mode | |
| LHSV, $hr^{-1}$ | 4 |
| Temperature, °F. | 900 |
| Pressure, psig | 400 |
| Hydrogen, SCF/B | 9000 |

The results of the dual-mode process are set forth in Table 3 as follows:

TABLE 3

| | Composition of Reformate/Hydrocrackate Resulting From Dual-Mode Operation | | |
|---|---|---|---|
| | Actual Product Composition | Estimate of Composition from Conventional Reforming | Delta: PtUSY-Conventional |
| Reforming Mode | | | |
| $C_5+$, Octane, R + O | | 96.9 | |
| $C_5+$, wt. % | 90.76 | 93.1 | −2.34 |
| $nC_4$, wt. % | 2.42 | 1.6 | 0.82 |
| $iC_4$, wt. % | 2.16 | 0.8 | 1.36 |
| $C_3$, wt. % | 3.45 | 2.2 | 1.25 |
| $C_2$, wt. % | 0.99 | 1.1 | −0.11 |
| $C_1$, wt. % | 0.25 | 0.9 | −0.65 |
| $H_2$, wt. % | −0.02 | 0.4 | −0.42 |
| Hydrocracking Mode | | | |
| $C_5+$, Octane, R + O | | 103 | |
| $C_5+$, wt. % | 71.64 | 88.5 | −16.86 |
| $nC_4$, wt. % | 6.50 | 2.7 | 3.80 |
| $iC_4$, wt. % | 6.06 | 1.4 | 4.66 |
| $C_3$, wt. % | 10.97 | 3.6 | 7.37 |
| $C_2$, wt. % | 4.23 | 1.8 | 2.43 |
| $C_1$, wt. % | 1.56 | 1.4 | 0.16 |
| $H_2$, wt. % | −0.97 | 0.6 | −1.57 |

Although at 17 wt.% below conventional reforming the $C_5+$ yield of the hydrocracking mode operation is relatively low, the substantial increase in $C_{3-4}$ saturates realized during hydrocracking makes the dual-mode reforming/hydrocracking process of this invention an attractive way to respond to rapidly fluctuating levels of supply and demand for high octane gasoline and LPG products.

Although the invention has been descrbied in conjunction with specific embodiments, it is evident that many alternatives and variations will be apparent to those skilled in the art in light of the foregoing description. Accordingly, the invention is intended to embrace all of the alternatives and variations that fall within the spirit and scope of the appended claims.

What is claimed is:

1. A dual-mode hydrocarbon conversion process which comprises reforming a hydrocarbon feedstock containing at least one component selected from the group consisting of sulfur-containing material, nitrogen-containing material and olefin-containing material in a single hydrocarbon conversion reaction zone operated under reforming conditions which include a temperature of from about 600° F. to about 1200° F., a pressure of from about 100 psig to about 300 psig, a liquid hourly space velocity of from about 0.1 to about 20 and a hydrogen circulation rate of from about 1000 to about 10,000 standard cubic feet/barrel employing as catalyst a noble metal-containing crystalline silicate having a Constraint Index of not greater than about 2 and a framework $SiO_2/Al_2O_3$ ratio of at least about 50 to provide a reformate prior to or following hydrocracking a feedstock which is identical to that of the reforming feedstock in said hydrocarbon conversion reaction zone operated under hydrocracking conditions which include an operating pressure of from above about 350 psig to about 1000 psig, a temperature of from about 500° F. to about 1000° F., a volume hourly space velocity of from about 1 to about 10 and a hydrogen to hydrocarbon ratio of from about 1 to about 10, and employing the aforesaid catalyst to provide a hydrocrackate, said reformate containing more $C_5+$ hydrocarbons and less $C_{3-4}$ hydrocarbons than said hydrocrackate and said hydrocrackate containing less $C_5+$ hydrocarbons and more $C_{3-4}$ hydrocarbons than said reformate.

2. The process of claim 1, wherein said feedstock is an olefin-containing gasoline derived from a catalytic cracking process.

3. The process of claim 2, wherein said gasoline is selected from the group consisting of fluidized catalytically cracked gasoline, Thermofor catalytically cracked gasoline and thermally cracked gasoline.

4. The process of claim 1, wherein said zeolite has a framework $SiO_2/Al_2O_3$ ratio of greater than 500:1.

5. The process of claim 1, wherein said reforming conditions include a temperature of from about 750° F. to about 1000° F. and a hydrogen circulation rate of from about 1500 to about 3500 standard cubic feet/barrel.

6. The process of claim 1, wherein said hydrocracking conditions include a temperature of from about 500° F. to about 800° F. and a volume hourly space velocity of from about 1 to about 4.

7. The process of claim 1, wherein said crystalline silicate is selected from the group consisting of those silicates having the structure of zeolite Beta, zeolite L, zeolite Y, mordenite, faujasite, ZSM-3, ZSM-4, ZSM-18 and ZSM-20.

8. The process of claim 5, wherein said crystalline silicate is selected from the group consisting of those silicates having the structure of zeolite Beta, zeolite L, zeolite Y, mordenite, faujasite, ZSM-3, ZSM-4, ZSM-18 and ZSM-20.

9. The process of claim 6, wherein said crystalline silicate is selected from the group consisting of those silicates having the structure of zeolite Beta, zeolite L, zeolite Y, mordenite, faujasite, ZSM-3, ZSM-4, ZSM-18 and ZSM-20.

10. The process of claim 7, wherein said zeolite Y is an ultrastable zeolite Y.

11. The process of claim 8, wherein said zeolite Y is an ultrastable zeolite Y.

12. The process of claim 9, wherein said zeolite Y is an ultrastable zeolite Y.

13. The process of claim 1, wherein said noble metal is platinum.

14. The process of claim 13, wherein said platinum is present in combination with at least one member of the group consisting of rhenium and iridium.

* * * * *